US005906149A

United States Patent [19]

Montenegro Criado

[11] Patent Number: 5,906,149

[45] Date of Patent: May 25, 1999

[54] ANVIL FOR ROTARY SLOTTING AND CUTTING MACHINES

[76] Inventor: Manuel Montenegro Criado, Urbanización Puente Romano, 60, 36393 Sabaris-Bayona (Pontevedra), Spain

[21] Appl. No.: 08/894,276

[22] PCT Filed: Nov. 29, 1996

[86] PCT No.: PCT/ES96/00232

§ 371 Date: Sep. 30, 1997

§ 102(e) Date: Sep. 30, 1997

[87] PCT Pub. No.: WO97/19793

PCT Pub. Date: Jun. 5, 1997

[30] Foreign Application Priority Data

Nov. 30, 1995 [ES] Spain ..... 9503275
Sep. 20, 1996 [ES] Spain ..... 9601991

[51] Int. Cl.[6] ..... B26D 7/20

[52] U.S. Cl. ..... 83/659; 83/346; 83/698.42

[58] Field of Search ..... 83/659, 346, 347, 83/348, 698.42, 658

[56] References Cited

U.S. PATENT DOCUMENTS

| | | | |
|---|---|---|---|
| 2,748,699 | 6/1956 | Bobst . | |
| 3,045,594 | 7/1962 | Buttner . | |
| 3,172,321 | 3/1965 | Schrader | 83/659 |
| 3,285,642 | 11/1966 | Sauer . | |
| 3,522,754 | 8/1970 | Sauer | 83/659 |
| 3,577,822 | 5/1971 | Sauer | 83/659 |
| 3,633,246 | 1/1972 | Kirkpatrick | 83/659 |
| 3,871,777 | 3/1975 | Sauer . | |
| 4,031,600 | 6/1977 | Whigham | 83/659 |
| 4,073,207 | 2/1978 | Kirkpatrick | 83/659 |
| 4,075,918 | 2/1978 | Sauer | 83/659 |
| 4,791,846 | 12/1988 | Kirkpatrick . | |
| 4,867,024 | 9/1989 | Cho et al. | 83/659 |
| 4,982,639 | 1/1991 | Kirkpatrick . | |
| 5,076,128 | 12/1991 | O'Connor et al. | 83/698.42 |
| 5,078,535 | 1/1992 | Kirkpatrick | 83/659 |
| 5,720,212 | 2/1998 | Kirkpatrick | 83/659 |

FOREIGN PATENT DOCUMENTS

| | | |
|---|---|---|
| 076777 | 4/1983 | European Pat. Off. . |
| 196443 | 10/1986 | European Pat. Off. . |

*Primary Examiner*—M. Rachuba
*Assistant Examiner*—Sean Pryor
*Attorney, Agent, or Firm*—Klauber & Jackson

[57] ABSTRACT

These transforming machines which process cardboard plates or the like for fabricating packages are comprised of two rollers defined as the die and the anvil, the die carrying the cutting and slitting knives. The plate of cardboard or the like passes between the two cylinder in such a rotary cutting die system. According to the invention, the anvil is defined by a tubular part (20) comprised of a rigid core (21) and a cut-resistant material which is cured on said core (21). The anvil (20) is divided into two complementary parts (23 and 24), one of them having a development which is slightly higher than the other one. There is incorporated a fast hooking system for connecting the two parts (23 and 24) forming the tubular part (20). The hooking system comprises an undulated tubular part (20). The hooking system comprises an undulated profile (25) in the front joining portions of both parts (23 and 24), one of them having lugs (26) which can be nested into complementary housings (27) of the other part. The lugs have a side protuberance configured like a spear (29) which are introduced into an enlargement (30) sideways of the housing (27).

16 Claims, 8 Drawing Sheets

ANVIL FOR ROTARY SLOTTING AND CUTTING MACHINES

OBJECT OF THE INVENTION

The present invention, as expressed in the statement of this Specification, refers to an anvil for rotary slotting and cutting machines, which obtains the transformation of the cardboard plates for the fabrication of boxes and packages.

The machinery used for the fabrication of cardboard packages, parting from plates, are called transforming machines and one of their main characteristics is that of conducting the necessary cuts and marking of the bends on the cardboard plates, which permit the forming of the box or package.

In all cases, said machines have a part in common which incorporates the necessary elements for cutting and slitting cardboard (knife heads, dies, etc.) and another part, which acts as anvil or support of the cardboard plate and which offers the neccessary consistency so as to produce the cut or marking of the slit. In order to understand well this task, it is compared with a butcher's knife and wooden block which is used as support on which the knife, after cutting the meat embeds into the wood. This wood, with anvil or backing functions gave, in the first place, consistency to the piece of meat to be cut, and secondly, the knife penetrated the wood, without thus damaging its edge.

The process for cutting the cardboard plates and marking them for the forming of packages, is called slotting or cutting. The machines which normally conduct this, may be designed for working with said cardboard cutting and slitting elements, of flat shape (die or knife distributed over a flat surface which works against an also flat anvil), or else, the configuration of die and arrangement of the knives is performed on the surface which develops a cylinder, and in this case, it is designed in cylindrical shape or as a ring.

As described in the previous paragraph, the different types of machines for handling the cardboard, may be classified in three following groups:

Flat cutting machine

Slotting machine

Rotary cutting machine.

A fundamental difference between said types of machines is the arrangement of the knives and the anvil. In the flat cutting machine, they are placed on two flat and parallel surfaces, whilst with the remaining groups, the cutting elements form several cylinders which work against the anvils, also cylindrical. Said arrangement of both elements, forced the anvils to be also different as regards their mechanical characteristics, up to the present.

Due to the accuracy permitted by the construction of the flat die, a surface for the rigid material anvil (steel) is used in said machines, whereas in the rotary die and versus the unfeasibility of having dies available with said accuracy, the use of supports or soft material anvils is resorted to, which counteract the difficulties of the rotary die.

This characteristic of the soft material anvil or support in slotting machines and in rotary cutting machines, forced machine manufacturers, during many years who were users and suppliers of anvils, to search for solutions which would permit the satisfaction of the requirements of all, and thus to achieve that the rotary die made use of its high productivity advantages, improving at the same time, the quality of the finished product.

Since it involves a soft and elastic material into which the die or slotting knives penetrate, it signifies that said parts wear rapidly, which obliges their frequent replacement. If said changing operation is conducted with the correct frequency, the result of the machine is satisfactory, though this situation is not normally produced due to different reasons which shall be commented herewith.

It is at this point, where, according to the invention, a new design for anvils or supports for rotary slotting and cutting machines is offered, which permit that the notable charactistical advantages of the present invention are reached.

The cylindrical anvil is formed by a series of bushes or rings placed in juxtaposition until they reach the total length of the support cylinder. Said assembly of bushes or partial anvils, may be installed in two different modalities:

a) the assembly of anvils rotate with the cylinder, and for this, there exists inside the bush, a key which is inserted into the transversal groove of the cylinder. During the task, the anvils do not separate because the stops of the ends block them, forming one single assembly.

b) the assembly of anvils rotate freely over the cylinder. In this case, it is mandatory to join all the anvils to each other, since otherwise, the circular knives of the die would separate the anvils and the cut would not be regular. Another disadvantage is that the ends of each anvil would deform, expanding at each union of anvils, and in time, the necessary space between the stops and the ends of the assembly would disappear, forming a blocking which would impede the free rotation.

The existance of a space between the stops and the assembly of anvils is necessary, since once all the anvils are joined to each other, it is required that the ends of the assembly are not pressed by said side stops, so that the assembly may rotate independently from the axis which supports them, keeping at each end from 4 to 6 mm separation approximately, thus preventing a possible blocking between the assembly of anvils and the support axis.

BACKGROUND OF THE INVENTION

At the beginning of the rotary dies, the flat die technique was used, as regards height of the die knives, profiles of said knives, etc., and the cylinder of the anvil or counterdie, was also constructed in steel. This theory was correct and work with the first machines in said conditions was tried, though the first difficulties soon appeared: the knives, coincident with the generatrix of the cylinder, required more pressure for cutting than the circular knives and other disadvantages, which forced the designing of a rotary die which, due to its characteristics made it very costly and unfeasible.

The next step in the evolution of said technique during the last years, consisted in developing a counterdie or anvil of soft and elastic material (elastomers) which permitted the knife to penetrate and to have the sufficient consistency to conduct the cutting of the cardboard.

This phase coincides with the commencement of the development in the industry of polymers and the suppliers are few and the quality low. Under said conditions, this form of cutting evolved and extended rapidly. The anvils, first with the steel base and after with aluminium, was coated with the soft material (elastomer). The soft material used, also improved its characteristics in time, and in parallel, the machines were more rapid each time; the greater rhythm of work made it necessary to change the counterdies a greater number of times, and those anvils, with metallic cores, started to result heavy for an operation which became more frequent each time. Also, the requirements demanded that said changes be conducted in shorter periods of time, thus preventing dead, non productive times of the machine.

Another great disadvantage was that once the metallic cores were removed from the machine, they were sent to the elastomer manufacturers to be vulcanized. This process was long, expensive and forced a high number of stored stocks to be available, in provision of long delivery times.

Faced with this new situation, a more versatile practical system was developed in the United States, which consisted in the use of bands. These had two advantages (a more rapid assembly and after use, they are disposable), due to which as from then, and after solving the present problems, the started to have a masive use. This good result, was also due to the improvement of the quality of the raw material used, which continued and currently continues to evolve. The described improvements, compensated in excess the only aspect in which said bands lost efficiency as regards the vulcanization; on becoming a lighter piece and with only one thin steel foil as support, which makes it very manageable, after a time of working in the machine, it losses the initial consistency and the clearance it acquires makes it less reliable than the the same vulcanized material on a more consistent core, this effect having repercussions on the quality of the cutting of the cardboard, and in consequence, on the finished product.

As has been indicated, said bands are discarded after use and in their place a new assembly is placed. Then, both for the manufacturer of the product and for the distributor and user, said formula was perfect. The two latter could maintain an adequate and cost acceptable stock at that moment, indifferent to the disadvantages supposed by the shipments and reshipments of cores for its recovery.

Since approximately eight years ago, other manufacturers of polyurethane anvils (elastomers) after acquiring the technology for the handling of polymers, have introduced innovations in said bands, such as the use of the glass fibre base/support and new hook system which facilitates the interchange of the parts.

Another improvement carried out during the last years, is the use of bushes which rotate freely over the anvil carrier axis. An improvement is thus achieved as regards the wear of the bands and an improved finish of the cut box. The bands are assembled on said bushes, in the same manner as when conducted directly on the cylinder, which gives rise to the previously indicated disadvantages.

These changes were very positive and permitted the increase of the cuota in the Market in a rapid and constant manner. Besides the commented modifications of the bands, it also includes the constant changes in the Market: the most suitable distribution systems, requirements for the use as regards reduction of stocks, needs of obtaining boxes cut with a greater degree of quality, tendency on behalf of the client to attain better prices in purchases, producing margins, at the same time turning more frequently to the Service Companies, so that the same solves the global problems and leaving the responsibility of supplies in their hands, among which the bands of the die-carrier anvil bands are to be found.

DESCRIPTION OF THE INVENTION

Therefore, as a consequence of the evolution of the rotary dies, and of the high level acquired in the fabrication of elastomers applied to this sector, the study and necessary knowledge for the development of the system of anvils with the characteristics proposed by the invention and which covers all the requirements of the users, has been permitted, in such a manner that the abundant studies of the Market carried out with the first groups at world level of the fabrication of undulated cardboard and of the manufacturers of machines and auxiliary equipments, predicts very positive results, since potential clients show an interest in knowing each day the state of said development.

A part of the success expected to be obtained with this system is because it is additionally presented at the opportune moment, taking advantage of the continuous evolution of the elastomers, also thanks to the current possibilities of distribution and facility of access to the Markets of other countries and versus the present demands of the users, as to quality of work, need for services and compliance with environmental standards.

Consequently, in general lines, the anvil for rotary slotting and cutting machines, which constitutes the object of the invention, includes the advantages of the previous systems, and taking advantage of new materials, corrects the disadvantages previously presented. As regards the more recent bands, the facility and rapidity of assembly is considerably improved with a totally original design, as well as the quality of the work when using the vulcanization and since a rigid, light and stable core is involved, it shall be recoverable and reusable. As has already been indicated, versus the current demands, any of the three characteristics in themselves will suppose an acceptance on behalf of the users. The system presented, includes the three following advantages:

Rapidity of assembly and interchange.

Superior quality of the work conducted, by the use of elastomers, vulcanized on rigid cores and the possibility of frequent interchanges.

Rigid, light and stable cores, which are easily recoverable and reusable.

It is defined by a tubular piece comprised of a rigid core and a cut-resistant material, vulcanized on the core. It is divided into two parts and the special design of the parts to be joined, makes the force carried out when taking one part against the other, to break down in order to generate a component which automatically forces the guides or lugs of one of the parts, to nest in the housings existing on the other, when a side displacement is produced. At the same time, said guides present a geometry which causes the closure of the ring when they come against the stop, remaining firmly locked. In order that said locking is performed perfectly and without any problem, soft polyurethane parts exist on the stops which absorb the impact and afterwards act for an effective locking.

These same elastic stops act at the moment of disassembly of the part. Thus, levering sideways, and once the locking of the part is overcome, and it is freed, the thrust produced by the elastic polyurethane, acts on the first part and expels it, thus facilitating the disassembly of each part and of all the assembly.

Consequently a fast assembly of the anvil is achieved, since one of the integrating parts have a slightly superior development than the other.

The fast hooking system for the interconnection of both parts, includes an undulated profile on the front joining fronts of both, being provided at confronted points, with the nesting lugs and the respective complementary housings. The thrust lugs follow an annular direction and each one of them are provided with a protuberance configured like a spear and axial direction, and in the shape of a preferred embodiment. Said lugs are likewise equiped with a chamfer or undercut at the free end, though on the opposite part to that of the exit of the protuberance configured like a spear, thus materilizing the initial leading point of a part against the side in the manner of a ramp provided on the corresponding housing of the other part. Said receptor housing is provided with a side enlargment for nesting of the protuberance configured like a spear.

Other improvements presented by the invention are defined by the inclusion of safety latches which are placed on the respective ends of the "male" portion of the bush, that is to say, the one including the projecting portions of the fast hook system and in the modality of assembly when the assembly of partial anvils rotates freely around the support cylinder.

As has been previously indicated, between the anvil of the end and the stop a space must exist. Additionally, the hooks with their spears and or projections which permit the fast union of the "male" bush and the "female" bush, have a design which offers the least resistance at the moment of assembly and disassembly of each anvil. Said two characteristics cause the smaller portion of the bush (the "male" portion), of the last bush or of the assembled partial anvil, to be removed from the "female" during service. That is the reason for the existance of said safety latch. The latch acts by locking the "male" and the "female" and is activating by means of a lever from the side through the corresponding orifices or windows existing on the edge of this portion of the bush.

Another improvement consists on providing the assembly with joining cramps which possibilitate the interconnection of all the bushes to each other, and which are placed in juxtaposition to form the cylindrical roller or annular band which materializes the comprised anvil. Said cramps have a "U" shape and their branches are inserted into the respective housing on the inside wall of the bush, very near to the edge of the same.

One of the ends of the cramp is embedded prior to assembly, into a "female" and when the anvil is assembled on the cylinder, the flexible part and the end which is going to be inserted into the following anvil protect sideways.

Said cramps of each anvil is to be found advantageously situated on the "female" portion and in a number of three. On the opposite edge, each "female" is provided with meshing gaps to receive the cramp of the previous anvil. The function of the three cramps is to join the anvils sideways, though only the centre one, additionally, it impedes an anvil from advancing as regards the next, in the rotation direction during service. The two cramps of the ends do not perform said function, since their design must permit the assembly of the next "female", said "female" being approximated to the radius direction, besides the possibility of attaching the same by displacing the part sideways.

Both the safety latches and the joining cramps are designed in such a way that, besides performing their function in a satisfactory manner, are not detrimental to the main object of the system, which is the fast changing of the anvils.

The third of the advantages included with the anvil in question, is determined by the elastic stop which is installed on the anvil-carrier cylinder, at its ends. In additional to its function of stopping the assembly of anvils sideways, it presents the characteristic of easily permitting its assembly and disassembly, since in some case, and depending on the position of the assembly, more space is required, in addition to the initial clearance, between the last partial anvil and the stop, in order to disassemble the "male" portion of the same, and said portion is disassembled by performing a side displacement. Thus, by means of a fast operation, the end of the cylinder may be freed without increase of time.

One additional characteristic is defined by the possibility of changing said stop by another with different width, since, as has been previously indicated, a certain clearance was required between the assembly of anvils and the stops. Said clearance may vary after various hours of service, due to expansions on the anvils of the cramps which, though they would be individually minimal, it must be considered that each partial anvil or bush has an approximate width of 230 mm, and for an average width of machine of 2500 mm, ten units are required. Said variation may be compensated with the use of different widths of stops.

Also provided, is the possibility of redesigning said elastic stop so that, by means of an activating mechanism, the same may be hidden and automatically positioned in order to perform the three functions without requiring its replacement.

Finally, the improvement which consists in providing an air cushion for the displacement of the assembly of bushes or partial anvils must be mentioned. It must be remembered that the main advantage of all said system, is the rapidity of interchange of the anvil position. In addition to the hooking system and other described elements, the air cushion permits saving time when it rotates the bushes to compensate wear, removing one or two anvils from an end and assemblying them on the opposite end. In order to perform this, it is necessary to displace the rest of the parts towards the side on which the ones removed were to be found previously.

In the free rotation version, as has been indicated, all the parts are joined to each other and it is required to move all the assembly sideways with rapidity and ease.

In the utility mode in which the assembly of anvils rotates with the cylinder, when the unlocking of the end (stop) is performed, the parts may be displaced independently in groups of two or three anvils. Though it is thus valid, in this case the displacement may also be provided by means of an air cushion which acts only at the moment of the change. Said pneumatic cushion consists of a chamber axially arranged on the anvil-carrier cylinder with compressed air input, and which is provided, on the faying surface with the anvils, with numerous orifices which, when the compressed air exits, makes all the assembly of anvils float. It is only necessary, that at this moment the perforated part of the cylinder remains situated on the high part when the machine stops. It may be performed manually, or by providing a device situating the cylinder in said position.

In order to facilitate the understanding of the characteristics of the invention, and forming integral part of this Specification, sheets of drawings are enclosed, in the figures of which, with illustrative and non limitative character, the following have been represented:

DESCRIPTION OF THE PREFERRED EMBODIMENT

With reference to the numbering adopted in the figures, it may be observed that in relation with FIGS. 1 through 6, different conventional dies and anvils have been shown, for cutting undulated cardboard plates or the like, as well as how to mark for the formation of slots and bending lines to possibilitate the mounting of the box or package.

Figure 1:
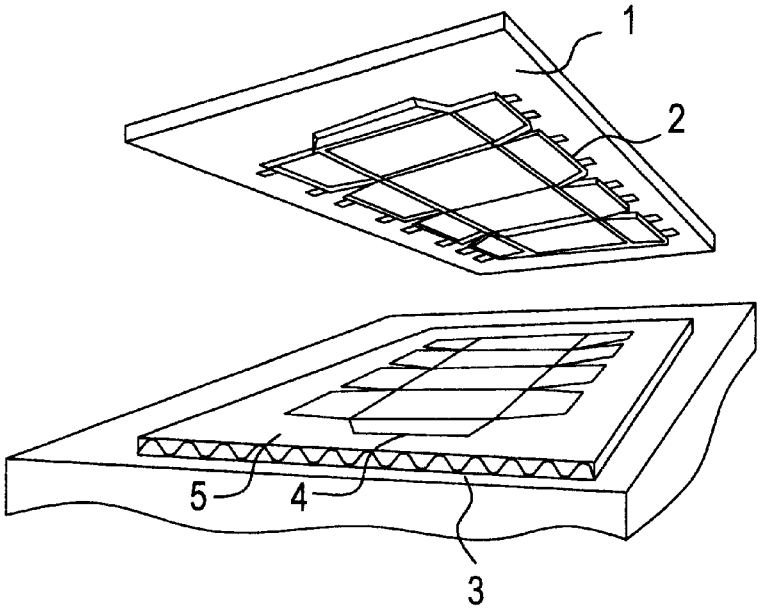
FIG. 1 PRIOR ART
FIG. 1 represents a perspective, exploded view of a flat die and anvil, for conventional slotting and cutting machines.
Figure 2:
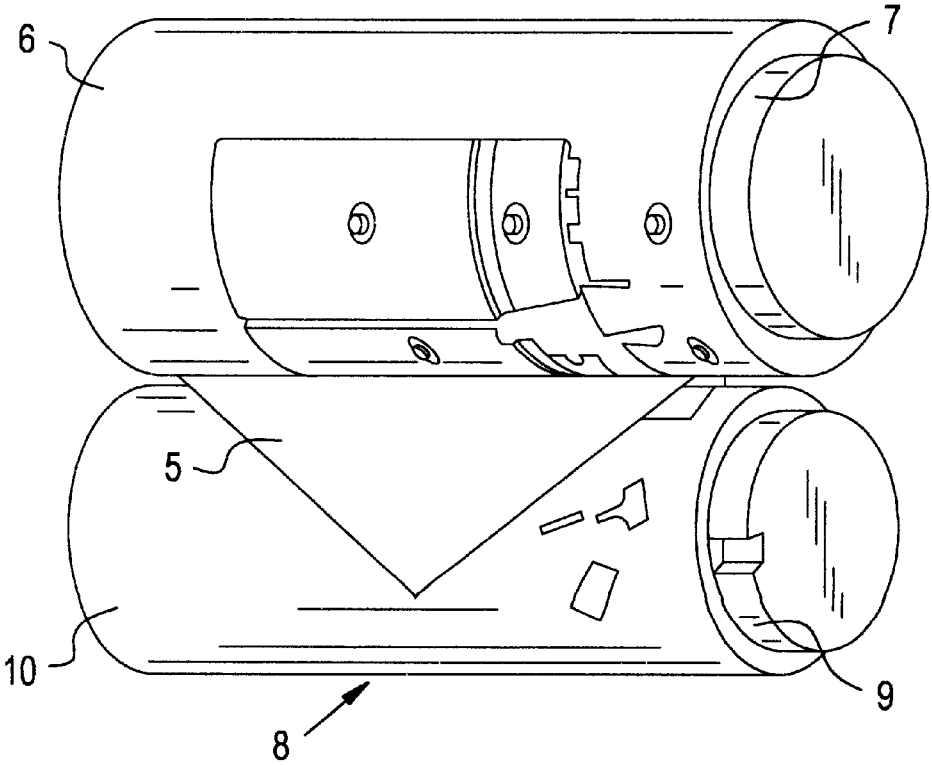
FIG. 2 PRIOR ART
FIG. 2 is a perspective, exploded view of a cylindrical die and anvil, used for the conventional rotary cutting.

Thus, in FIG. 1, referenced with number 1, is the flat die, which is the carrier of knives 2, being conventionally of wood. The flat die 1 attacks on the steel anvil 3 for producing the slitting cut 4 on the undulated cardboard plate or the like 5. FIG. 2 shows the cutting and slotting system in conventional rotary machines, in which a cylindrical die 6 exists on a core or die-carrier 7. The knives are arranged periperically on the die 6 and attack the support or cylindrical anvil 8 or counterdie with a core 9 by means of a soft and elastic coat 10, normally of polyurethane, permitting the knife to penetrate in order to perform the cutting of the cardboard plate 5.

Figure 3:
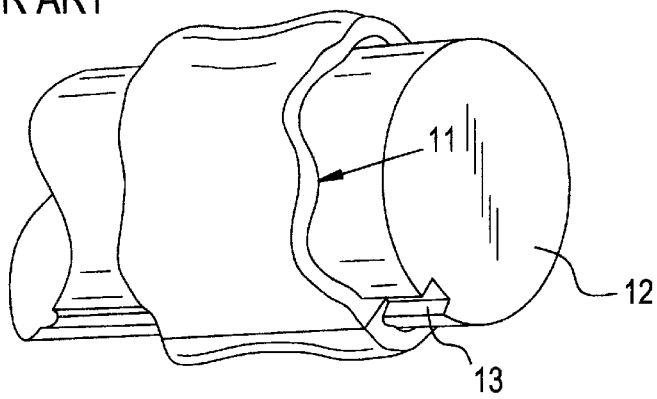
FIG. 3 PRIOR ART
FIG. 3 is a perspective, exploded view of a conventional cylindrical anvil with disposable bands, in this case, steel foils.
Figure 4:
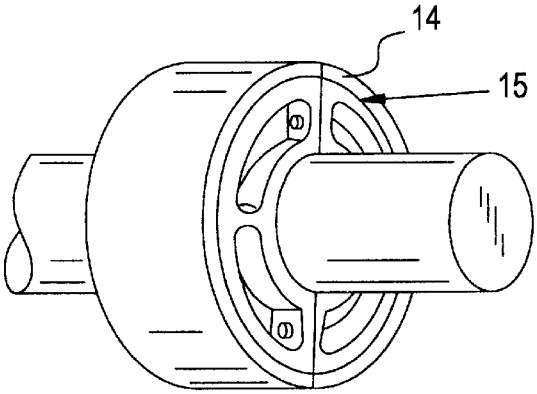
FIG. 4 PRIOR ART
FIG. 4 is a similar view to FIG. 3, of a conventional anvil equipped with a soft material vulcanized on aluminium.

In FIGS. 3 and 4 may be observed several anvils for conventional rotary cutting, with the most practical and versatile system for the use of the bands. Band 11 is constructed of a thin steel foil as backing material, coated with a soft material. The ends of the band 11 are anchored to the core 12 since the same is equipped with a longitudinal grooving 13.

FIG. 4 referenced with number 14, is the soft material vulcanized on the aluminium rigid tubular core.

Figure 5:
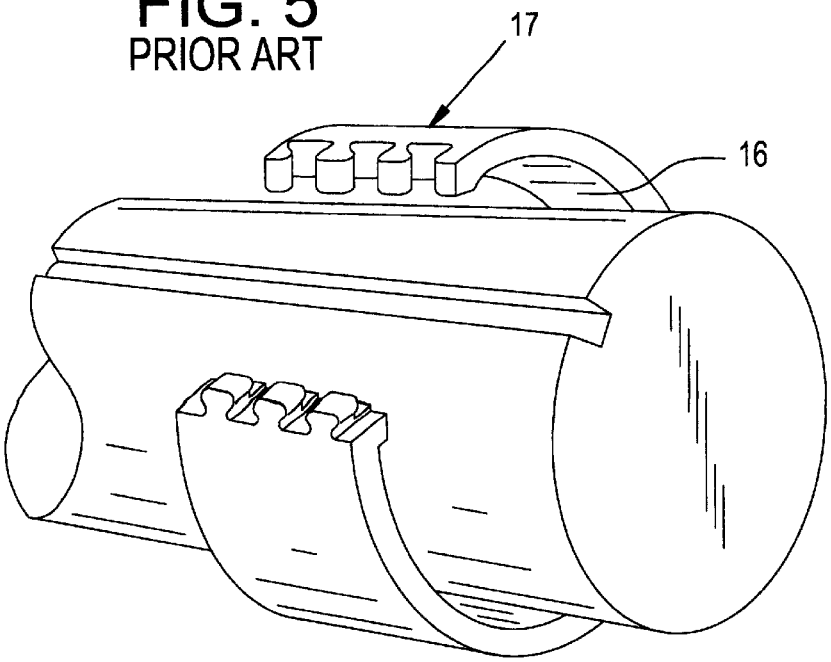
FIG. 5 PRIOR ART
FIG. 5 is another similar view to FIG. 3, of an anvil covered by a glass fibre band and a hooking system, also conventional.

Other manufacturers of polyurethane anvils (elastomers), improved said bands in accordance with representation in FIG. 5, using glass fibre 16 as base/backing material. The hooking system which facilitates the interchange of the bands is constructed of a "male-female" system, based on dovetails, as is clearly seen in said FIG. 5. Said band is referenced with number 17.

Figure 6:
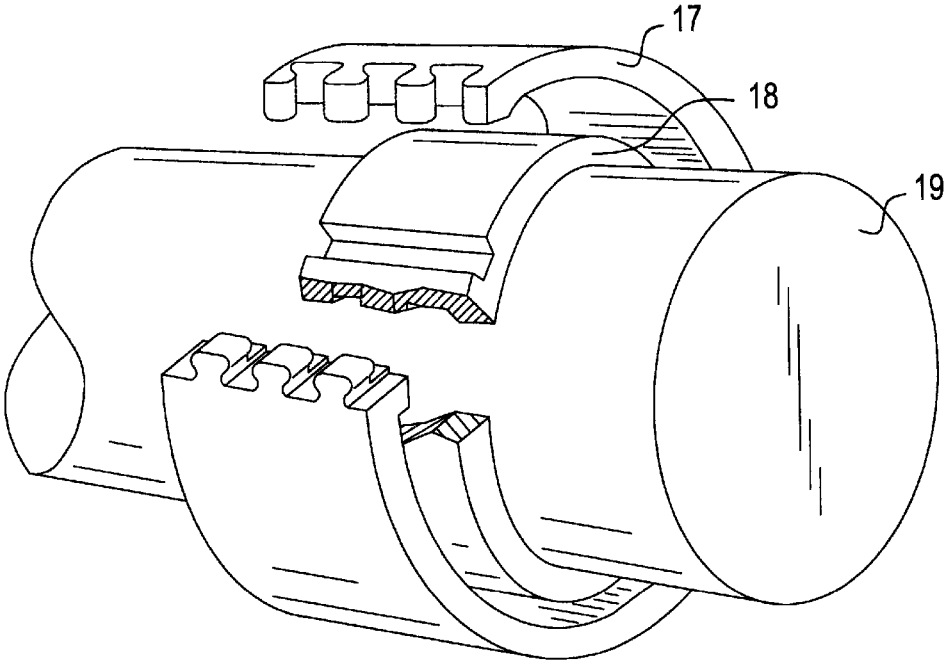
FIG. 6 PRIOR ART
FIG. 6 is a similar view to FIG. 4, with the anvil provided with a replaceable band arranged on the rigid bush, in conventional manner.

FIG. 6 reflects another improvement which has progressively been effected, which consists in the use of bushes 18 with free rotation around the anvil-carrier axis 19. On bushes 18, bands 17 are assembled, as in the previously indicated case, in relation to FIG. 5.

Figure 7:
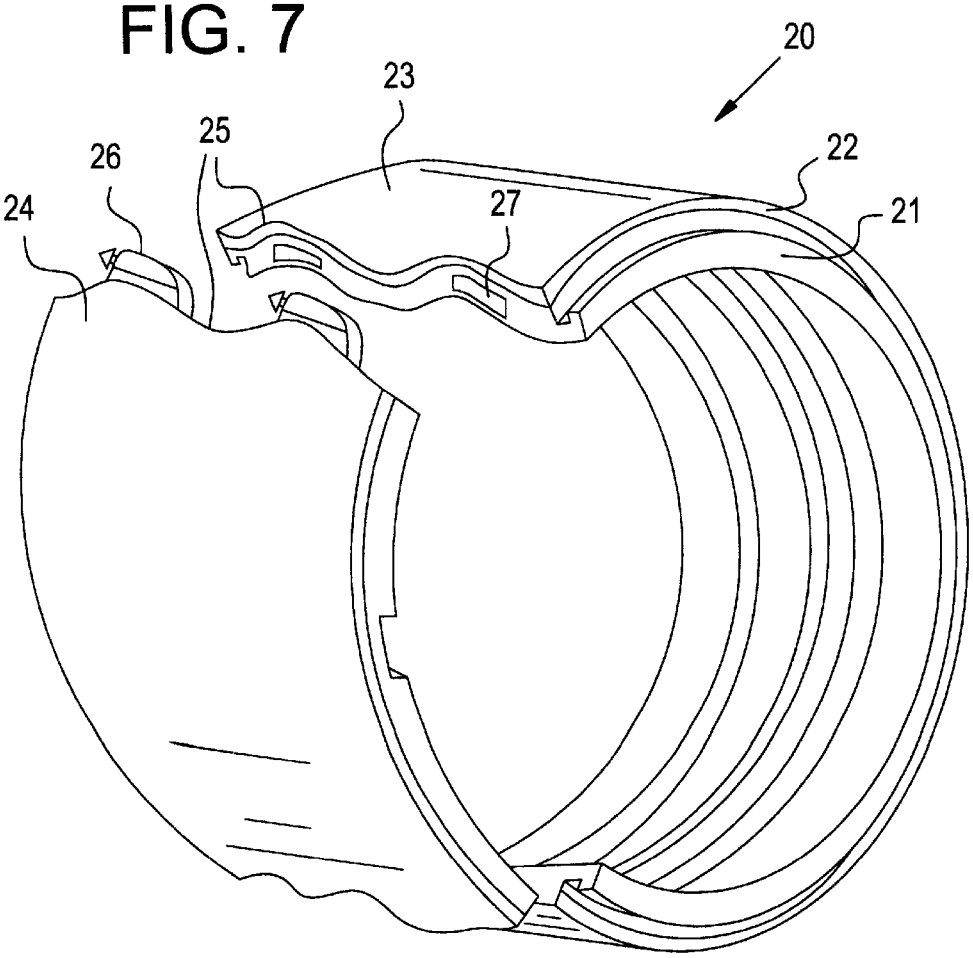
FIG. 7 is a perspective, exploded view, of the replaceable band of the anvil, according to the invention, including the fast assembly system, formed by a rigid core and a cut-resistance material which is vulcanized on the core.

According to the invention, such as has been observed in FIG. 7, the anvil is referenced generally with number 20 and is constituted by a rigid core with a coat 22 of cut-resistant material, vulcanized on said core 21. For its assembly on the anvil-carrier, it is divided into two parts 23 and 24, one of them having a development slightly higher than the other.

The fast hooking system of both parts 23 and 24, which are components of anvil 20, include an undulated profile 25 as finish off ends or fronts of both parts, lugs 26 existing on one of them, for nesting in complementary housings 27 of the other part 23.

Figure 8:
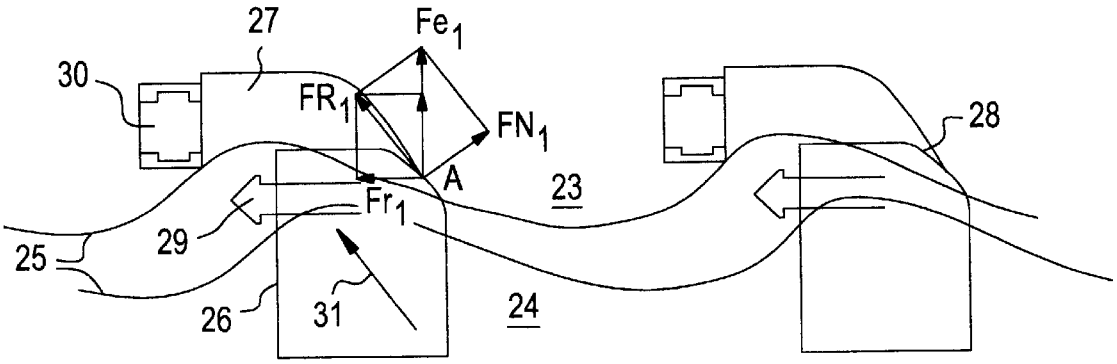
FIGS. 8 through 11 are different exploded views which show the assembly sequence of the two component parts of the tubular piece which materializes the anvil which is the object of the invention, according to FIG. 7.

FIGS. 8 thrugh 11 represent different phases of the hooking system, in an assembly sequence and without the existance of auxiliary elements or prior assembly operations, all the elements being incorporated in the cores.

Force $Fe_1$, performed when taking a part 24 over the other 23, such as is seen in FIG. 8, is broken down into a force which results in the direction of movement ($FR_1$), and another force in normal direction to the surface ($FN_1$). Force ($Fr_1$) is the component of ($F_1R$) in the input direction to the housing. At the contact point A of lug 26 with the bottom end in ramp shape of the housing 27, there exists a sliding, and an increase is produced in the inertia due to the resultant force ($FR_1$) in the direction of movement. Lugs 26 have a chamfer or undercut 28 at the contact point A with housing 27.

Figure 11:
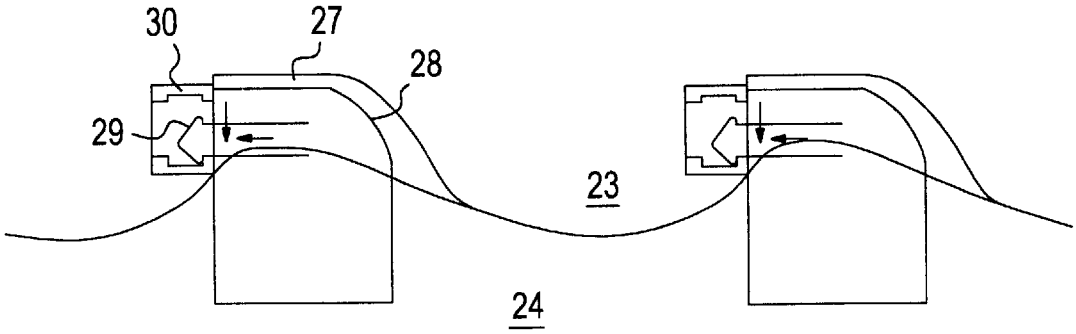

When lugs or guides 26 stop on closure of the ring, they remain firmly locked when the projection 29 with its point configured like a spear and which emerges in axial direction to lug 26, interconnects with the enlargment 30 existing in axial direction to the side wall of the housing 27 (FIG. 11 shows the nesting and closure position of the ring).

In order that the perfect locking may be achieved without the existance of problems, lugs 26 inserted in the portion of core 24, have soft polyurethane zones which dampen the impact and afterwards act so that the locking is effective. The soft or elastic zone is found located on the left hand side of FIGS. 8 thru 11 and on the same, the pin which comprises the projection 29 configured like a spear may be observed. FIG. 10 shows an exploded view, in interrupted lines, of the elastic behaviour of said projection 29 until it nests in the enlargment 30.

Figure 9:
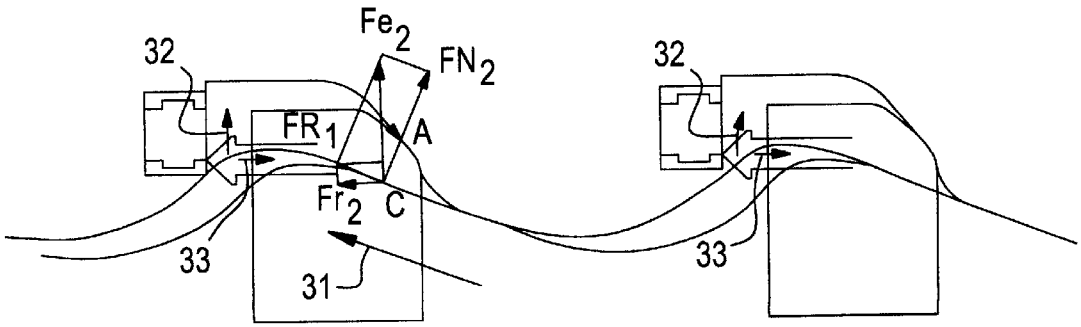
Figure 10:
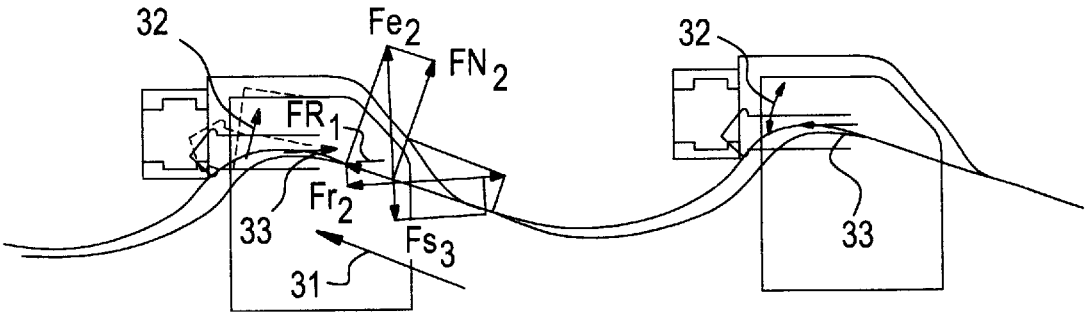

FIG. 9 also shows the force flow chart at the moment of coupling, after that of FIG. 8. $Fe_2$ designates the thrust force (at the moment indicated by the position on the drawing); $FN_2$ is the component in normal direction to the surface, $FR_2$ is the component force in direction to the movement (this movement direction is represented with an arrow 31). $Fr_2$ is the component of $FR_2$ in the input direction of the housing. When projection 29 configured as a spear contacts with the enlargment 30, (point marked with a B), the wedge which defines the projection 29 acts with $Fr_2$ plus the inertia adhered to $F_1r$. This forces an elastic yielding, or if it is already yielded, to elongate said projection in order to commence the advance towards the tie-down point. At this moment the interchange of the contact point occurs, which passes from point A to point C, the latter marked by the contacting of both parts 23 and 24 of the annular anvil 20.

At the moment of the hooking, as shown in FIG. 10, an elongation and crushing is produced on the hooking zone of the projection 29 configured as a spear, in the direction to arrows 32 and 33 in upward direction and towards the right hand side respectively. In this same FIG. 10, the moment of the hooking may also be analyzed, a relaxation existing by the movements in opposite direction to those described, and a $Fs_3$ force which helps the separation of parts 23 and 24.

The hooking system covered by the invention, is possible due to the quality of the material used in the core, since it deals with a lighter, more resistance and stable material than the one used previously. The old, conventional vulcanized cores, besides the weight, also failed in the assembly. In order to disassemble and assemble them it was necessary to handle the screws which joined them and said task took a long time, also requiring at least two operators and in addition, the adjustment between the two component parts did not result to be reliable since it also involved aluminium parts.

It has been indicated that in order to perform perfectly the locking between both parts of the anvil 20, soft polyurethane zones exist on the housing, which dampen the impact and afterwards act to make the locking effective. Due to said characteristic, the actual elastic stops act at the moment of disassembling the part. Thus, on performance of a side levering, and once the locking of the part 24 has been achieved and it is freed, the thrust of the elastic polyurethane spring acts on the first part and expels it, facilitating in this manner, the disassembly of each part and of all the assembly.

FIG. 7, represents the design of the section of anvil 20, which permits the provision of a great resistance and considerably reduces its weight, as well as permitting a correct width of the contact points with the anvil-carrier cylinder.

Another step in the development of new forms of rotary cutting and taking advantage of the new materials, is also the use of a rigid counterdie, conserving the hooking system recommended. In said cases, the bases or cores could be the same, coated or vulcanized with a new material or forming one single assembly.

Figure 12:
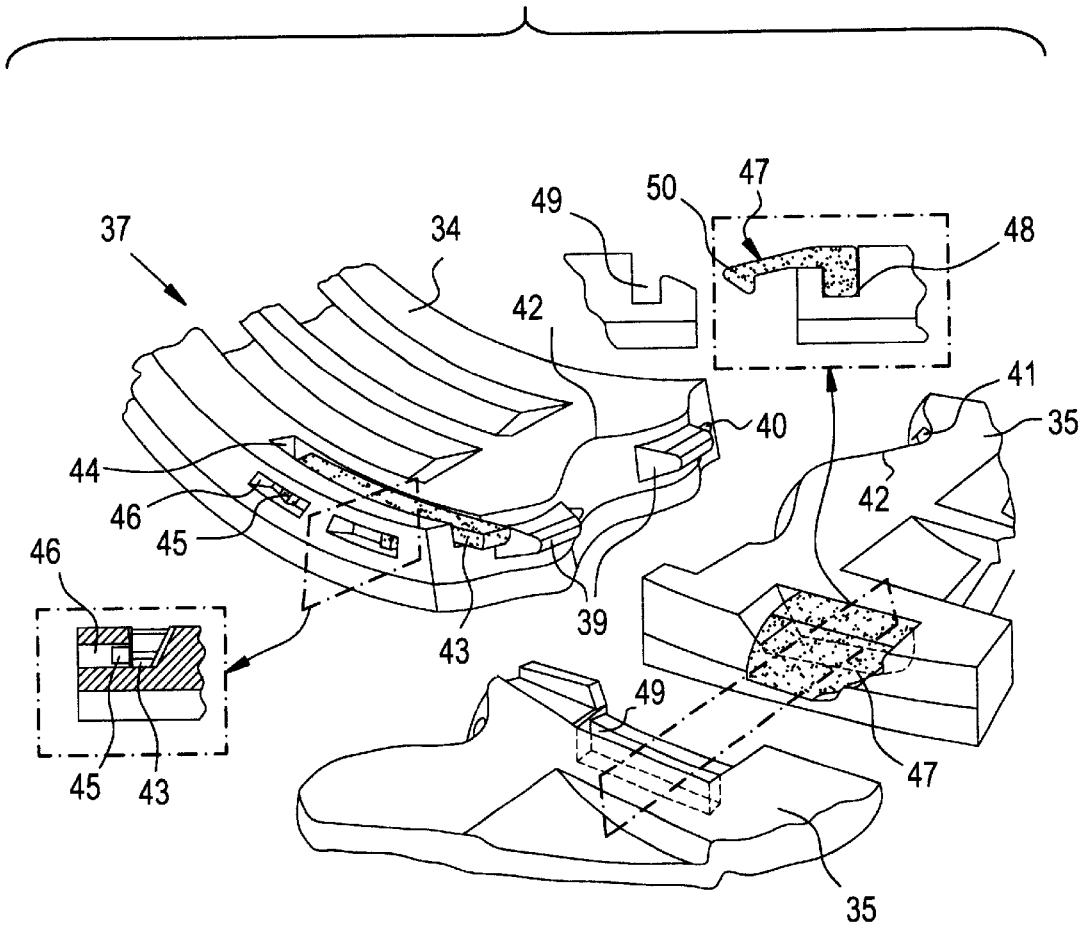
FIG. 12 is a partial and perspective view of an anvil for rotary slotting and cutting machines, which include the improvements which are the object of the invention, specifically the ones defining the safety latches and the joining cramps.
Figure 13:
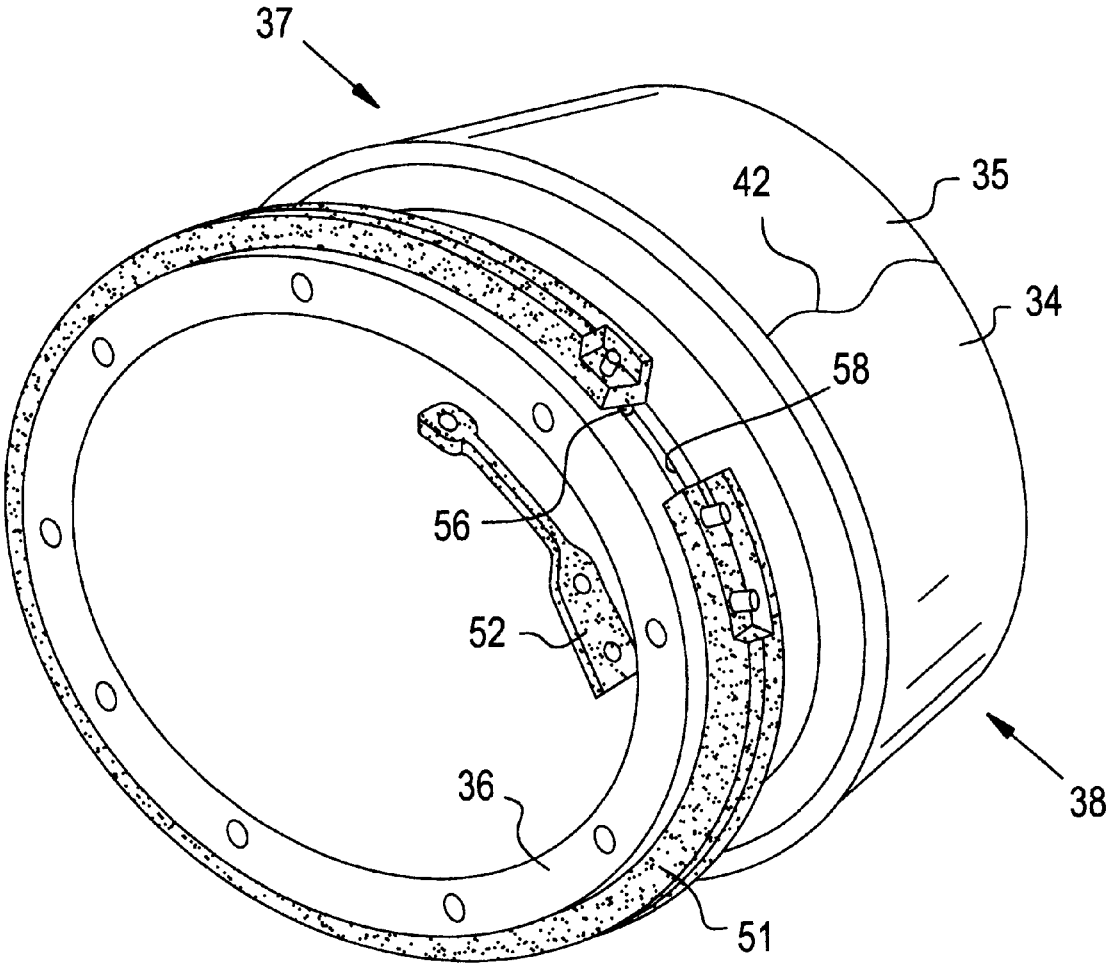
FIG. 13 is a perspective view of the elastic stop which must be situated on one of the ends of the bush assembly support cylinder, installed on the support cylinder, the same being partially shown.
Figure 14:
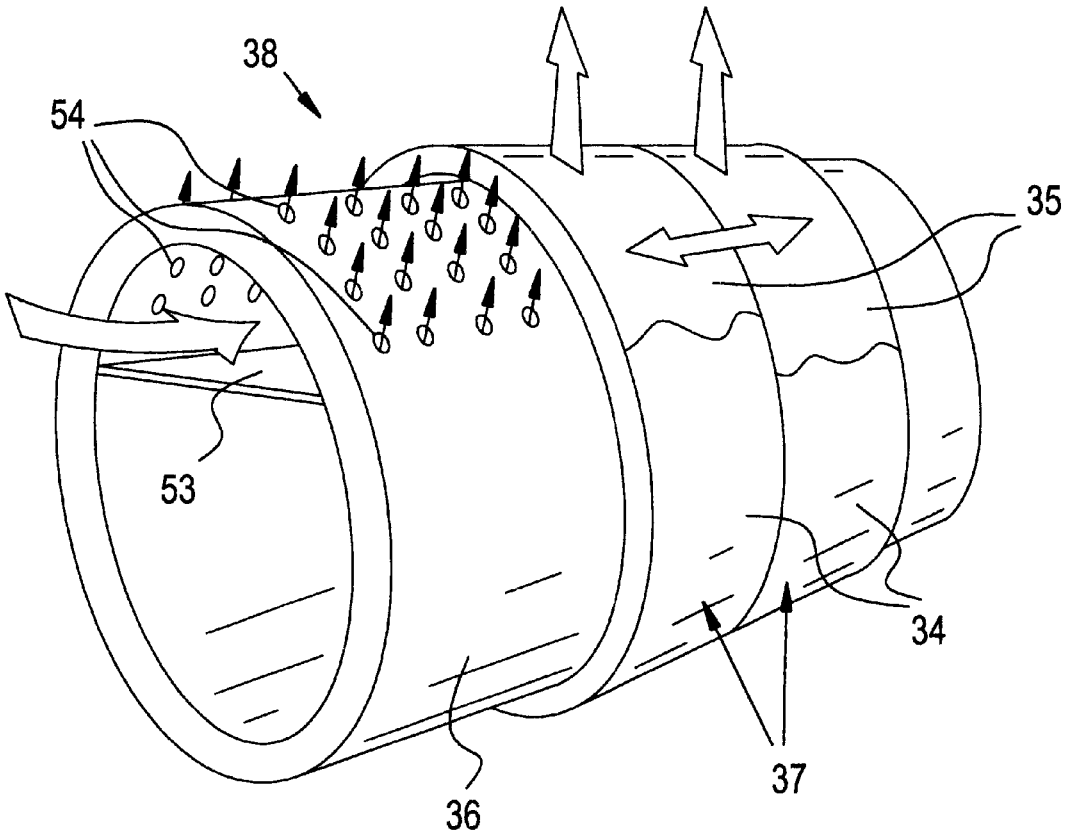
FIG. 14 is a perspective view of a portion of the anvil showing the inside chamber which possibilitates the formation of the air cushion for displacement of the bushes or partial anvils assembled on the support cylinder.

With reference to the numbering adopted in FIGS. 12 thru 14, it can be observed how each one of the bushes which are placed in yuxtaposition on the support cylinder, is formed by the union of two parts: the "male" portion 34 and the "female" portion 35. The support cylinder is referenced with number 36 and shown schematically in FIG. 14, and the complete bush or partial anvil is referenced in general with number 37. The assembly of the anvil or counterdie, is referenced in general with number 38 and is formed when placing bushes 37 coaxially on support cylinder 36.

FIG. 12 represents how the "male" part 34 of bush 37 includes lugs 39 and lateral projections 40 configured like a spear for nesting inside the complementary housings 41 of the "female" portion 35, the faying surface of said two complementary portions having an undulated profile 42.

In said FIG. 12 safety lugs 43 may be observed, arranged in sliding manner on the respective notches 44 of the inside wall of the "male" portion 34, being activated from the outside to act by means of a lever on the side spigots 45 which emerge from several windows 46 provided on the front annular portion of the same. Though it is not seen on the figures, there exists on the walls of said windows 46, complementary protuberances and recesses on the lug 43, for tiedown in open or closed positions.

In the same FIG. 12 is referenced with number 47, the cramps make possible the union of the bushes 37 to each other which are placed axially in juxtaposition to form the cylindrical roller 36 which makes up the anvil. In the detail situated on the top righthand side of said FIG. 12, the "U" shape adopted by cramp 47 may be seen.

Cramps 47 are situated on the "female" portion 35, specifically on the notches or housings 48 respectively. On the opposite edges are provided the nesting gaps 49, the nesting being performed due to the fact that cramp 47 is equipped with an elastic web and finished off with a configuration like a spear 50 which defines a sloped plane which slides on the one existing also on the "female" adjacent part, at the entrance of gap 49.

Housings 48 for the prior assembly of cramp 47, as well as gaps 49 which receive cramp 47 of the previous bush, are duplicated and said arrangement permits the placement of a "female" of a partial anvil, forward or backward as regards the "female" of the previous anvil as is observed in FIG. 14. In this manner two effects are achieved:

$1^{st}$—To break the continuity of the union of all the anvils throughout the width of the cylinder (machines of up to 4 m width).

$2^{nd}$—When a "female" moves forward as regards the previous one, a point of support for the "male" of the previous anvil is obtained. Thus only one safety lug 43 may be used in one single central anvil, without requiring the existance of two lugs, the provision of more than one lug of an anvil also not being necessary, only on the last partial anvil is where the two lugs 43 must exist.

Cramps 47 connect with a certain pressure, in such a manner that their extraction offers no difficulty, though the sufficient attachment must exists to serve as protection to the edge of the anvil. Thus, when an operator handles the anvils they may be left to drop to the floor (on the edge of the cramps 47) without damage to the edge of the bush or to the edge of its coating.

From the three cramps which are placed on the "female" portion of a bush 37, one, the central one, has the second end with a different design to that of the ones placed at the points.

With special reference now to FIG. 13, the elastic stop which is assembled on the ends of the anvil-carrier cylinder 36, is referenced with number 51, with open annular shape which has been previously contemplated and a section on which an inside rib 56 stands out which houses in an annular throat 58 provided peripherically on the cylinder 36, for its axial immobility after the latching of its ends by means of the locking strap 52. The distance between the elastic stop 51 and the bush or end anvil 37 of the assembly, may be adjusted due to the existance of elastic stops 51 with different widths, as has been previously indicated.

In order to change rapidly the position of the anvils 37, an air cushion was provided to facilitate the displacement. This may be seen in FIG. 14, and is materialized by chamber 53 which defines a segmented portion of the inside of the anvil-carrier tubular cylinder 36. The wall of the cylinder, corresponding to said chamber, possesses a plurality of orifices 54 for passage of the compressed air which invades said chamber 53 when orifices 54 are found placed on the top part and the machine is stopped in order to carry out the interchange of the anvils. As is shown by means of arrows, at the moment in which pressure is applied to the pneumatic circuit, the air which passes through the orifices 54 elevates the partial anvils 37 and when its weight is counteracted, it may be axially displaced with great ease and rapidity, naturally, once the end elastic stop 51 has been disassembled.

I claim:

1. AN ANVIL FOR A ROTARY SLOTTING AND CUTTING MACHINE including a roller selected from the group consisting of rollers with cylindrical shape and rollers shaped as annular bands, said roller being provided with marking and cutting elements adapted to slot and cut material received by said machine, said anvil comprising:

a tubular piece of generally cylindrical shape having a rigid core and a cut-resistant material coating vulcanized on said core; said tubular piece being constituted by a first part and a second part;

a transversal cross section of said first part having a first arcuate extension, and a transversal cross section said second part having a second arcuate extension, such that said first and second arcuate extensions combine to form a circumference of said tubular piece wherein one of said first and second arcuate extensions corresponds to larger portion of said circumference than the other one of said first and second arcuate extensions;

a fast hooking system for interlocking said first part and said second part during assembly of said tubular piece, each of said first and second parts including two longitudinal edges having an undulated profile arranged such that said profile of said longitudinal edges of said first part are complementary to said profile of said corresponding longitudinal edges of said second part such that said first and second parts can be interconnected along said complementary longitudinal edges, whereby at least one of said longitudinal edges includes nesting lugs and at least one of said complementary longitudinal edges includes housings, said housings being complementary to said lugs in order to receive said lugs during interconnection of said first and second parts, said lugs and housings being shaped such that when a force directed substantially perpendicularly to said longitudinal edges is bringing said first and second parts into contact with each other along said longitudinal edges, a reaction force is created that has a component thereof directed in a direction parallel to said longitudinal edges, said reaction force causing a lateral displacement of one of said first and second parts with regard to the other one of said first and second parts, whereby the lugs interlock with said housings;

such that upon operation of said machine, said roller is arranged with said anvil to attack said anvil during advancement of material to be processed by said machine.

2. AN ANVIL according to claim 1, in which said lugs extend in a direction substantially perpendicular to said corresponding longitudinal edge and are equipped with a protuberance configured as a spear and with a direction substantially parallel with said corresponding longitudinal edge, said protuberance being arranged in a first side of said lug, said lug further being provided with a chamfer on an second side of said lug, said second side being opposite to said first side, said lug and said corresponding housing being arranged such that said chamfer will contact a ramp portion of the housing during interconnection of said first and second parts, said housing being equipped with a lateral recess for housing the protuberance (29, 40).

3. AN ANVIL according to claim 1, wherein said anvil is formed by a series of bushes which are placed in juxtaposition.

4. AN ANVIL according to claim 3, further comprising safety latches located on respective ends of corresponding parts having lugs of at least two bushes, said bushes corresponding to respective lateral ends of said anvil made up of a plurality of bushes, said safety latches being displaceable in a direction perpendicular to longitudinal ends of said part, said safety latches being slidable in respective notches of inside walls of said parts, and activated from outside by means of two side spigots, emerging through front windows of said bushes.

5. AN ANVIL according to claim 3, further comprising a joining cramp which make possible an interconnection of all said bushes which are placed in juxtaposition to form said anvil, said cramp comprising branches which are inserted in respective housings of side walls of said bush, said cramp comprising a joining section of said branches which has a certain elasticity which permits hooking by axial displacement of an adjacent bush.

6. AN ANVIL according to claim 5, wherein said housings for said cramps are located on a part of each bush that comprises housings for said lugs, said housings being duplicated to permit an angular offset in the assembly of the different bushes throughout a length of a anvil-carrier cylinder.

7. An anvil according to claim 3, further comprising elastic stops assembled on ends of a cylinder that carries the bushes making up the anvil, in order to limit axial displacement of said bushes along said cylinder while permitting their independent rolling and disassembly of first and second parts of an end bush, the interchange with other elastic stops of different widths being provided for in order to compensate changes of length by expansions and clearances, said elastic stops adopting an open annular shape, with an inside rib which is housed in an annular throat of said cylinder, the ends of the elastic stops being equipped with insertion means of a closure strap.

8. AN ANVIL according to claim 3, wherein different bushes may be axially displaced along a cylinder, for an interchange of said anvil with at least one other anvil, means for creating a pneumatic cushion being provided comprising a chamber formed inside said cylinder and throughout the length of said cylinder, to which compressed air may be provided, exiting through a plurality of radial orifices which cross the wall of said cylinder.

9. An Anvil for rotary slotting and cutting machines, according to claim 2, characterized in that the cylindrical anvil is formed by a series of bushes (37) which are placed in juxtaposition until they reach the total length of an anvil-carrier cylinder.

10. AN ANVIL according to claim 2, wherein said stop lugs include soft parts which dampen impact during assembly of the anvil and make said lugs flexible in order to permit interlocking of the protuberance with the corresponding recess of the housing and disengagement of the protuberance from said recess.

11. AN ANVIL according to claim 9, wherein said soft parts are made of polyurethane.

12. AN ANVIL FOR A ROTARY SLOTTING AND CUTTING MACHINE including a roller selected from the group consisting of rollers with cylindrical shape and rollers shaped as annular bands, said roller being provided with marking and cutting elements adapted to slot and cut material received by said machine, said anvil comprising:

a tubular piece of generally cylindrical shape having a rigid core and a cut-resistant material coating vulcanized on said core;

a transversal cross section of said first part having a first arcuate extension, and a transversal cross section said second part having a second arcuate extension, such that said first and second arcuate extensions combine to form a circumference of said tubular piece wherein one of said first and second arcuate extensions corresponds to larger portion of said circumference than the other one of said first and second arcuate extensions;

a fast hooking system for interlocking said first part and said second part during assembly of said tubular piece, each of said first and second parts including two longitudinal edges having an undulated profile arranged such that said profile of said longitudinal edges of said first part are complementary to said profile of said corresponding longitudinal edges of said second part such that said first and second parts can be interconnected along said complementary longitudinal edges, whereby at least one of said longitudinal edges includes nesting lugs and at least one of said complementary longitudinal edges includes housings, said housings being complementary to said lugs in order to receive said lugs during interconnection of said first and second parts, said lugs and housings being shaped such that when a force directed substantially perpendicularly to said longitudinal edges is bringing said first and second parts into contact with each other along said longitudinal edges, a reaction force is created that has a component thereof directed in a direction parallel to said longitudinal edges, said reaction force causing a lateral displacement of one of said first and second parts with regard to the other one of said first and second parts, whereby the lugs interlock with said housings;

such that upon operation of said machine, said roller is arranged with said anvil to attack said anvil during advancement of material to be processed by said machine;

wherein said anvil is formed by a series of bushes which are placed in juxtaposition; and safety latches located on respective ends of corresponding parts having lugs of at least two bushes, said bushes corresponding to respective lateral ends of said anvil made up of a plurality of bushes, said safety latches being displaceable in a direction perpendicular to longitudinal ends of said part, said safety latches being slidable in respective notches of inside walls of said parts, and activated from outside by means of two side spigots, emerging through front windows of said bushes.

13. AN ANVIL FOR A ROTARY SLOTTING AND CUTTING MACHINE including a roller selected from the group consisting of rollers with cylindrical shape and rollers shaped as annular bands, said roller being provided with marking and cutting elements adapted to slot and cut material received by said machine, said anvil comprising:

a tubular piece of generally cylindrical shape having a rigid core and a cut-resistant material coating vulcanized on said core; said tubular piece being constituted by a first part and a second part;

a transversal cross section of said first part having a first arcuate extension, and a transversal cross section said second part having a second arcuate extension, such that said first and second arcuate extensions combine to form a circumference of said tubular piece wherein one of said first and second arcuate extensions corresponds to larger portion of said circumference than the other one of said first and second arcuate extensions;

a fast hooking system for interlocking said first part and said second part during assembly of said tubular piece, each of said first and second parts including two longitudinal edges having an undulated profile arranged such that said profile of said longitudinal edges of said first part are complementary to said profile of said corresponding longitudinal edges of said second part such that said first and second parts can be interconnected along said complementary longitudinal edges, whereby at least one of said longitudinal edges includes nesting lugs and at least one of said complementary longitudinal edges includes housings, said housings being complementary to said lugs in order to receive said lugs during interconnection of said first and second parts, said lugs and housings being shaped such that when a force directed substantially perpendicularly to said longitudinal edges is bringing said first and second parts into contact with each other along said longitudinal edges, a reaction force is created that has a component thereof directed in a direction parallel to said longitudinal edges, said reaction force causing a lateral displacement of one of said first and second parts with regard to the other one of said first and second parts, whereby the lugs interlock with said housings;

such that upon operation of said machine, said roller is arranged with said anvil to attack said anvil during advancement of material to be processed by said machine;

wherein said anvil is formed by a series of bushes which are placed in juxtaposition; and a joining cramp which make possible an interconnection of all said bushes which are placed in juxtaposition to form said anvil, said cramp comprising branches which are inserted in respective housings of side walls of said bush, said cramp comprising a joining section of said branches which has a certain elasticity which permits hooking by axial displacement of an adjacent bush.

14. AN ANVIL according to claim 13, wherein said housings for said cramps are located on a part of each bush that comprises housings for said lugs, said housings being duplicated to permit an angular offset in the assembly of the different bushes throughout a length of a anvil-carrier cylinder.

15. AN ANVIL FOR A ROTARY SLOTTING AND CUTTING MACHINE including a roller selected from the group consisting of rollers with cylindrical shape and rollers shaped as annular bands, said roller being provided with marking and cutting elements adapted to slot and cut material received by said machine, said anvil comprising:

a tubular piece of generally cylindrical shape having a rigid core and a cut-resistant material coating vulcanized on said core; said tubular piece being constituted by a first part and a second part;

a transversal cross section of said first part having a first arcuate extension, and a transversal cross section said second part having a second arcuate extension, such that said first and second arcuate extensions combine to form a circumference of said tubular piece wherein one of said first and second arcuate extensions corresponds to larger portion of said circumference than the other one of said first and second arcuate extensions;

a fast hooking system for interlocking said first part and said second part during assembly of said tubular piece, each of said first and second parts including two longitudinal edges having an undulated profile arranged such that said profile of said longitudinal edges of said first part are complementary to said profile of said corresponding longitudinal edges of said second part such that said first and second parts can be interconnected along said complementary longitudinal edges, whereby at least one of said longitudinal edges includes nesting lugs and at least one of said complementary longitudinal edges includes housings, said housings being complementary to said lugs in order to receive said lugs during interconnection of said first and second parts, said lugs and housings being shaped such that when a force directed substantially perpendicularly to said longitudinal edges is bringing said first and second parts into contact with each other along said longitudinal edges, a reaction force is created that has a component thereof directed in a direction parallel to said longitudinal edges, said reaction force causing a lateral displacement of one of said first and second parts with regard to the other one of said first and second parts, whereby the lugs interlock with said housings;

such that upon operation of said machine, said roller is arranged with said anvil to attack said anvil during advancement of material to be processed by said machine;

wherein said anvil is formed by a series of bushes which are placed in juxtaposition; and elastic stops assembled on ends of a cylinder that carries the bushes making up said anvil, in order to limit axial displacement of said bushes along said cylinder while permitting their independent rolling and disassembly of first and second parts of an end bush, an interchange with other elastic stops of different widths being provided for in order to compensate changes of length by expansions and clearances, said elastic stops adopting an open annular shape, with an inside rib which is housed in an annular throat of said cylinder, the ends of the elastic stops being equipped with insertion means of a closure strap.

16. AN ANVIL FOR A ROTARY SLOTTING AND CUTTING MACHINE including a roller selected from the group consisting of rollers with cylindrical shape and rollers shaped as annular bands, said roller being provided with marking and cutting elements adapted to slot and cut material received by said machine, said anvil comprising:

a tubular piece of generally cylindrical shape having a rigid core and a cut-resistant material coating vulcanized on said core; said tubular piece being constituted by a first part and a second part;

a transversal cross section of said first part having a first arcuate extension, and a transversal cross section said second part having a second arcuate extension, such that said first and second arcuate extensions combine to form a circumference of said tubular piece wherein one of said first and second arcuate extensions corresponds to larger portion of said circumference than the other one of said first and second arcuate extensions;

a fast hooking system for interlocking said first part and said second part during assembly of said tubular piece, each of said first and second parts including two longitudinal edges having an undulated profile arranged such that said profile of said longitudinal edges of said first part are complementary to said profile of said corresponding longitudinal edges of said second part such that said first and second parts can be interconnected along said complementary longitudinal edges, whereby at least one of said longitudinal edges includes nesting lugs and at least one of said complementary longitudinal edges includes housings, said housings being complementary to said lugs in order to receive said lugs during interconnection of said first and second parts, said lugs and housings being shaped such that when a force directed substantially perpendicularly to said longitudinal edges is bringing said first and second parts into contact with each other along said longitudinal edges, a reaction force is created that has a component thereof directed in a direction parallel to said longitudinal edges, said reaction force causing a lateral displacement of one of said first and second parts with regard to the other one of said first and second parts, whereby the lugs interlock with said housings;

such that upon operation of said machine, said roller is arranged with said anvil to attack said anvil during advancement of material to be processed by said machine;

wherein said anvil is formed by a series of bushes which are placed in juxtaposition; and wherein different bushes may be axially displaced along a cylinder, for the interchange of said anvil with at least one other anvil, means for creating a pneumatic cushion being provided comprising a chamber formed inside said cylinder and throughout the length of said cylinder, to which compressed air may be provided, exiting through a plurality of radial orifices which cross the wall of said cylinder.

* * * * *